US010399837B2

(12) United States Patent
Madden et al.

(10) Patent No.: US 10,399,837 B2
(45) Date of Patent: Sep. 3, 2019

(54) BEVERAGE DISPENSING SYSTEM

(71) Applicant: PEPSICO, INC., Purchase, NY (US)

(72) Inventors: Joseph Madden, Evansville, IN (US); Steven T. Jersey, Laguna Niguel, CA (US); Scott Loomis, Redlands, CA (US); Fernando Ubidia, Ludlow, MA (US)

(73) Assignee: PepsiCo, Inc., Purchase, NY (US)

( * ) Notice: Subject to any disclaimer, the term of this patent is extended or adjusted under 35 U.S.C. 154(b) by 1 day.

(21) Appl. No.: 15/637,681

(22) Filed: Jun. 29, 2017

(65) Prior Publication Data

US 2019/0002264 A1 Jan. 3, 2019

(51) Int. Cl.

| | |
|---|---|
| ***B67D 1/00*** | (2006.01) |
| ***B67D 1/06*** | (2006.01) |
| ***B67D 1/16*** | (2006.01) |
| ***B67D 1/08*** | (2006.01) |
| ***B67D 1/10*** | (2006.01) |

(52) U.S. Cl.

CPC ..... *B67D 1/0021* (2013.01); *B67D 1/0081* (2013.01); *B67D 1/06* (2013.01); *B67D 1/0872* (2013.01); *B67D 1/0888* (2013.01); *B67D 1/10* (2013.01); *B67D 1/16* (2013.01); *B67D 2001/0088* (2013.01); *B67D 2001/0089* (2013.01)

(58) Field of Classification Search

CPC ..... B67D 1/0021; B67D 1/10; B67D 1/0872; B67D 1/16; B67D 1/06; B67D 1/0081; B67D 1/0888; B67D 2001/0088; B67D 1/0051; B67D 1/0083; B67D 1/0079; B67D 2001/0087; B67D 1/0085

See application file for complete search history.

(56) References Cited

U.S. PATENT DOCUMENTS

| | | | | |
|---|---|---|---|---|
| 1,713,795 | A * | 5/1929 | Weber | B67D 1/0004 222/131 |
| 3,915,207 | A * | 10/1975 | Greenfield, Jr. | A47J 31/401 141/103 |
| 4,008,832 | A | 2/1977 | Rodth | |
| D324,464 | S * | 3/1992 | Credle, Jr. | D7/308 |
| RE33,943 | E * | 6/1992 | Arzberger | B67D 1/0028 222/129.1 |
| 5,305,927 | A * | 4/1994 | Caveza | B67D 1/0425 222/185.1 |
| 6,234,354 | B1 * | 5/2001 | Phillips | B67D 1/0021 222/129.1 |
| 2002/0088824 | A1 * | 7/2002 | Newman | B67D 1/0028 222/63 |

(Continued)

FOREIGN PATENT DOCUMENTS

FR 840904 A 5/1939

OTHER PUBLICATIONS

International Search Report dated Aug. 30, 2018, for International Application No. PCT/US2018/038026, 2 pages.

*Primary Examiner* — David P Angwin
*Assistant Examiner* — Bob Zadeh
(74) *Attorney, Agent, or Firm* — Sterne, Kessler, Goldstein & Fox P.L.L.C.

(57) ABSTRACT

A beverage dispensing system is provided. The beverage dispensing system can include a nozzle module connected to a beverage dispenser housing. The nozzle module can be vertically and/or horizontally spaced from a beverage dispenser valve and nozzle.

15 Claims, 11 Drawing Sheets

(56) References Cited

U.S. PATENT DOCUMENTS

| | | | | |
|---|---|---|---|---|
| 2006/0180610 | A1* | 8/2006 | Haskayne | B67D 1/0021 222/129.1 |
| 2007/0114244 | A1* | 5/2007 | Gatipon | B67D 1/0022 222/129.1 |
| 2010/0327017 | A1* | 12/2010 | Romanyszyn | B67D 1/0021 222/129.1 |
| 2011/0315711 | A1 | 12/2011 | Hecht et al. | |
| 2012/0298693 | A1 | 11/2012 | Jersey et al. | |
| 2014/0299630 | A1* | 10/2014 | Brown | B67D 1/06 222/129.1 |
| 2015/0102062 | A1* | 4/2015 | Mosimann | A47J 31/467 222/129.1 |

* cited by examiner

BEVERAGE DISPENSING SYSTEM

BACKGROUND OF THE INVENTION

Field

Embodiments of the present invention relate to a beverage dispenser. In particular, embodiments relate to a beverage dispenser nozzle module.

BRIEF SUMMARY OF THE INVENTION

One aspect of the invention permits a beverage dispenser including a dispenser housing including a valve retaining housing surface and a beverage dispensing valve extending from the dispenser housing. The beverage dispensing valve can include a dispenser nozzle and a valve housing to attach to the valve retaining housing surface. The beverage dispensing valve can be supported on the valve retaining housing surface such that the dispenser nozzle is generally aligned along a first axis. The beverage dispenser can include a nozzle module including a nozzle module housing having a first end abutting an upper end of the dispenser housing and a second end extending from the first end. The nozzle module can include a nozzle module nozzle adjacent the second end such that the nozzle module nozzle is aligned along a second axis that is parallel to and spaced apart from the first axis in a horizontal direction. In an aspect, the first axis can be spaced a first horizontal distance from the valve retaining housing surface and the second axis can be spaced a second horizontal distance from the valve retaining housing surface such that the second horizontal distance is greater than the first horizontal distance. The second axis can be spaced apart from the first horizontal axis a vertical distance in a range from approximately one inch to approximately 15 inches. In another aspect, the beverage dispenser can include a second beverage dispensing valve extending from the dispenser housing. The second beverage dispensing valve can include a second dispenser nozzle and a second valve housing to attach to the valve retaining housing surface. The second beverage dispensing valve can be supported on the valve retaining housing surface such that the second dispenser nozzle is generally aligned along the first horizontal axis. In an aspect, the nozzle module housing can be coupled to the dispenser housing. In another aspect, the nozzle module housing can be integral with the dispenser housing. In another aspect, the nozzle module can dispense a premeasured amount of fluid based on a first user input and a second user input. In a further aspect, the beverage dispenser can include a base attached to the lower end. The base can include a waste collection portion having a receptacle area. The dispenser nozzle can be positioned above the receptacle area to dispense a first fluid into the receptacle area and the nozzle module nozzle can be positioned above the receptacle area to dispense a second fluid into the receptacle area. In an aspect, the first fluid can be an additive ingredient and the second fluid can be a branded beverage. In another aspect, the nozzle module can include a control interface for regulating delivery of the second fluid. The control interface can include a switch and an electronic control system coupled to the switch and configured to receive electronic control signals from the control interface to regulate the delivery of the second fluid.

Another aspect of the invention permits a nozzle module for a beverage dispenser. The nozzle module includes a nozzle module housing having a first end to attach to a beverage dispenser housing and a nozzle adjacent a second end of the nozzle module housing such that the nozzle is configured to be spaced a first horizontal distance from the beverage dispenser housing. The beverage dispenser can include a beverage dispenser nozzle spaced a second horizontal distance from the beverage dispenser housing. The first horizontal distance can be greater than the second horizontal distance. In an aspect, the first horizontal distance can be a range from approximately one inch to approximately 10 inches. In an aspect, the nozzle can be configured to be spaced a vertical distance from the beverage dispenser nozzle. The vertical distance can be a range from approximately one inch to approximately 15 inches. In an aspect, the nozzle module can be configured to dispense a premeasured amount of fluid based on a first user input. The nozzle module can be configured to dispense the premeasured amount based on a second user input. In another aspect, the nozzle module can include a control interface for regulating delivery of the nozzle module fluid. The control interface can include a switch and an electronic control system coupled to the switch and configured to receive electronic control signals from the control interface to regulate the delivery of the nozzle module fluid.

Another aspect of the invention permits a nozzle module for a beverage dispenser including a beverage dispenser nozzle positioned above a beverage dispenser waste collection portion. The nozzle module can include a nozzle module housing configured to connect to a beverage dispenser housing at a first end and a nozzle module nozzle adjacent a second end of the nozzle module housing and configured to extend outwardly from the beverage dispenser housing such that the nozzle module nozzle is positioned above and outward from the beverage dispenser nozzle. The nozzle can be configured to be positioned above the beverage dispenser waste collection portion. The beverage dispenser waste collection portion can be configured to receive a first fluid from the beverage dispenser nozzle and a second fluid from the nozzle module nozzle. In an aspect, the nozzle module nozzle can be configured to be distal to the beverage dispenser housing along a horizontal axis and distal to the beverage dispenser nozzle along the horizontal axis. In an aspect, the nozzle module can include a first fluid line to supply a first fluid to the nozzle module nozzle and a second fluid line to supply a second fluid to the beverage dispenser nozzle. The nozzle module nozzle can be configured to dispense an additive ingredient and the beverage dispense nozzle can be configured to dispense a branded beverage.

One aspect of the invention permits a beverage dispenser including a base including a waste collection portion, the waste collection portion having a receptacle area. The beverage dispenser can include a dispensing tower having a lower end, an upper end, and a valve retaining housing surface, the lower end can be attached to the base. The beverage dispenser can include a plurality of beverage dispensing nozzles supported on the valve retaining housing surface, the plurality of beverage dispensing nozzles can be positioned above the receptacle area such that the receptacle area receives a first fluid dispensed from one of the plurality of beverage dispensing nozzles. The beverage dispenser can also include a nozzle module including a nozzle module housing having a first end abutting the dispensing tower upper end, and a second end projecting from the first end. The nozzle module can include a nozzle module nozzle adjacent the second end such that the nozzle module nozzle is positioned above the receptacle area such that the receptacle area receives a second fluid dispensed from the nozzle.

In a further aspect, the nozzle module housing can include a vertical portion including an upper end and a lower end that abuts the dispensing tower upper end, and a horizontal portion having a distal end and a proximal end, the proximal end abutting the vertical portion upper end. The nozzle module can include a pump positioned within an interior area of the vertical portion. The nozzle module can be configured to dispense a premeasured amount of fluid based on a first user input. The nozzle module can also be configured to dispense the premeasured amount based on a second user input. In an aspect, the beverage dispensing nozzles can be spaced a first horizontal distance from the valve retaining housing surface and the nozzle module nozzle can be spaced a second horizontal distance from the valve retaining surface such that the second horizontal distance is greater than the first horizontal distance. The nozzle module can include a cover that extends across the dispensing tower upper end. In another aspect, the nozzle module can include a control interface for regulating delivery of the second fluid. The control interface can include a switch. The nozzle module can also include an electronic control system coupled to the switch and configured to receive electronic control signals from the control interface to regulate the delivery of the second fluid. In addition, the nozzle module can be covered with merchandising material and can be positioned to avoid obscuring branding on the beverage dispenser.

One aspect of the invention permits a nozzle module for a beverage dispenser. The nozzle module include a nozzle module housing having a first end to attach to the beverage dispenser and a second end projecting from the first end, and a nozzle adjacent the second end such that the nozzle is positioned above a waste receptacle area that is configured to receive a nozzle module fluid dispensed from the nozzle and a beverage dispenser fluid dispensed from the beverage dispenser. The nozzle module housing can include a vertical portion including a lower end to attach to the beverage dispenser; and a horizontal portion having a proximal end that abuts an upper end of the vertical portion. The nozzle module can include a nozzle module pump positioned within an interior area of the vertical portion. The nozzle module can be configured to dispense a premeasured amount of fluid based on a first user input. The nozzle module can be configured to dispense the premeasured amount based on a second user input. In one aspect, the beverage dispensing nozzles can be spaced a first horizontal distance from the valve retaining housing surface and the nozzle module nozzle can be spaced a second horizontal distance from the valve retaining surface such that the second horizontal distance is greater than the first horizontal distance. In another aspect, the nozzle module can include a cover that extends across an upper surface of the beverage dispenser. In another aspect, the nozzle module can also include a control interface for regulating delivery of the nozzle module fluid. The control interface can include a switch and an electronic control system coupled to the switch and configured to receive electronic control signals from the control interface to regulate the delivery of the nozzle module fluid.

An aspect of the invention permits a method for retrofitting a beverage dispenser. The method can include attaching a nozzle module to the beverage dispenser. The nozzle module can include a nozzle module housing having a first end to attach to the beverage dispenser and a second end projecting from the first end. The nozzle module can also include a nozzle adjacent the second end such that the nozzle is positioned above a beverage dispenser waste receptacle area. The waste receptacle area can be configured to receive a nozzle module fluid dispensed from the nozzle and a beverage dispenser fluid dispensed from the beverage dispenser. The method can include fluidly connecting a beverage dispenser chilled water line to the nozzle module. The method can also include removing a merchandising module from the beverage dispenser, and attaching the nozzle module to the beverage dispenser in place of the merchandising module. The nozzle module can be covered with merchandising material and can be positioned to avoid obscuring branding on the beverage dispenser.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

Figure 1:
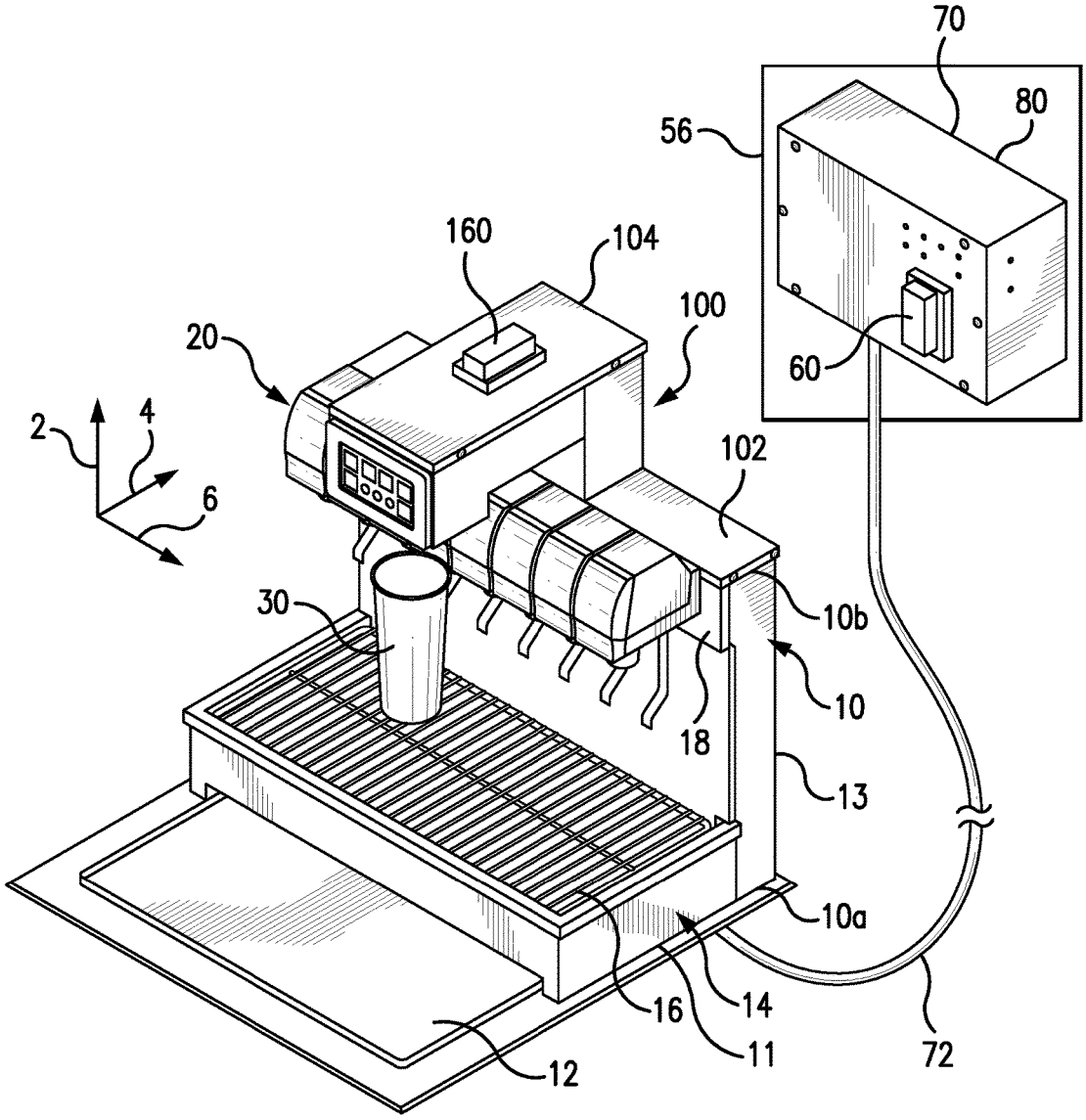
FIG. 1 is a perspective view of a beverage dispensing system according to various aspects of the invention.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Beverage dispensing units have become a popular way for food and beverage establishments to create on-site fountain beverages. Beverage dispensers often use "post-mix" beverage dispensing valves, which use two separate flow paths to dispense water (carbonated or non-carbonated, depending on the type of beverage) and syrup into a cup, in which the water and syrup mix to produce a beverage. Alternatively, "pre-mix" dispensers may dispense pre-mixed beverages. Post-mix systems often include several bag-in-box containers that each contains syrup, a liquid source that dispenses a liquid, a mixing unit, and a dispensing unit. Syrup is pumped from the bag-in-box container into the mixing unit where it is mixed with liquid to form a beverage that is then dispensed through the dispensing unit. Typically, a pump causes the syrup to be released from the bag-in-box container into the dispensing valves. Beverage dispensers often include a row of beverage dispensing valves, with each valve including a nozzle.

Drop-in style beverage dispensers can be designed to fit into a hole cut into a counter top or can be installed into a freestanding cabinet. Typically, drop-in style beverage dispensers include an open ice bin and are therefore for employee crew serve only. The ice bin can be used for storing ice that is used for filling the drink cups as well as cooling the products that run through the cold plate that is built into the dispenser. Beverage dispensing towers featuring one or more beverage dispensing valves can be utilized for dispensing carbonated and/or non-carbonated beverages.

Conventional beverage dispensing units and systems position the bag-in-box containers and the pump in a back room, such as a storage room or food preparation area, because they can be noisy and can be distracting to patrons. Alternatively, the bag-in-box containers and pump can be positioned nearby the beverage dispensing unit. For example, the bag-in-box containers and pump can be positioned below a countertop on which the dispenser rests.

The dispensing unit is oftentimes positioned in the foodservice area of the restaurant or bar so that staff and/or patrons may have access to it. These units are time-consuming to assemble, disassemble, and service because they are positioned in multiple rooms and because portions of the units are difficult to access. Assembly, disassembly, and service of this beverage dispensing units are oftentimes performed by a highly skilled technician due to the complex nature of the unit.

Regardless of the specific beverage dispenser design, post-mix beverage dispensing valves typically dispense only one beverage flavor per valve. The number of these "one-flavor" valves that a dispenser can accommodate is limited, and thus the valves are assigned to the most popular flavors, typically carbonated beverages (cola, diet cola, lemon-lime, root beer, etc.). Additional noncarbonated beverage flavors (e.g., iced tea, lemonade, pink lemonade, fruit punch, raspberry iced tea, etc.), require additional dispensers. In many cases, these dispensers are dedicated to a single flavor, to prevent mixing flavors between beverage dispensing cycles. The inclusion of additional valves requires additional counter space and can thus increase beverage dispensing cost.

Due to the infrastructure and nature of the systems including changeover cost and equipment replacement, sometimes it is less desirable to provide for additional beverages and/or beverage flavors in a food and beverage setting (e.g., restaurant, convenience store, grocery, or the like). A rotating dispenser offering different beverages and/or flavors might require components such as the syrup line to be replaced to avoid flavor cross-contamination from previous syrup flavors run through the line.

Additionally, less utilized beverages and flavors can be prone to expiration and can thus be less ideal in a post-mix environment with respect to supply chain and shelf life management perspective.

The present dispensing system delivers the capability of dispensing a finished beverage, a semi-finished beverage, or an additive ingredient using an integrated nozzle module that does not increase the footprint of the beverage dispenser. In one aspect, a flavor concentrate can be dispensed from the nozzle tower. In another aspect, carbonated water or still water can flow into the nozzle tower to mix with a beverage concentrate and provide additional beverage flavor options.

The embodiments discussed below may be used to form a wide variety of products, such as beverages, including but not limited to cold and hot beverages, and including but not limited to beverages known under any PepsiCo branded name, such as Pepsi-Cola®.

Aspects of the present invention will now be described with reference to FIGS. 1-11. Throughout the system, conventional beverage tubing (FDA approved for use with food products) is used to connect the components of the system. Any of the beverage tubing conduits may be insulated to prevent heat loss or gain. In the beverage dispensing system 10, a diluent source supplies diluent, e.g., water, to the system 10. In one aspect, the diluent can be at typical domestic water pressures, e.g., approximately 50-300 pounds per square inch (psi).

Beverage dispensing system 10 is shown in FIGS. 1-6. The term "beverage" has been used to readily convey exemplary embodiments to reader, however, those skilled in the art will readily appreciate that any fluid, liquid, gel, or similar product, including for example, concentrated syrup, is within the scope of the invention. In the discussion below, reference is made to vertical direction 2, horizontal direction 4, and width direction 6.

Beverage dispensing system 10 may generally resemble a traditional fountain-drink dispenser. In an aspect, beverage dispensing system 10 can include dispenser housing 13. Dispenser housing 13 can include a lower end 10*a* and an upper end 10*b*. Valve retaining housing surface 18 can be positioned on dispenser housing 13. In an aspect, valve retaining housing surface 18 can be positioned adjacent upper end 10*b*. Beverage dispensing system 10 can also include a base 11, ice chest 12, drip tray 14, and drip tray grate 16. Drip tray 14 can be positioned within base 11. In an aspect, drip tray 14 can include a receptacle area to collect fluid waste from beverage dispensing system 10 and/or nozzle module 100. In this manner, beverage dispensing system 10 and nozzle module 100 can utilize a common drip tray without the need to run additional drain lines.

Figure 2:
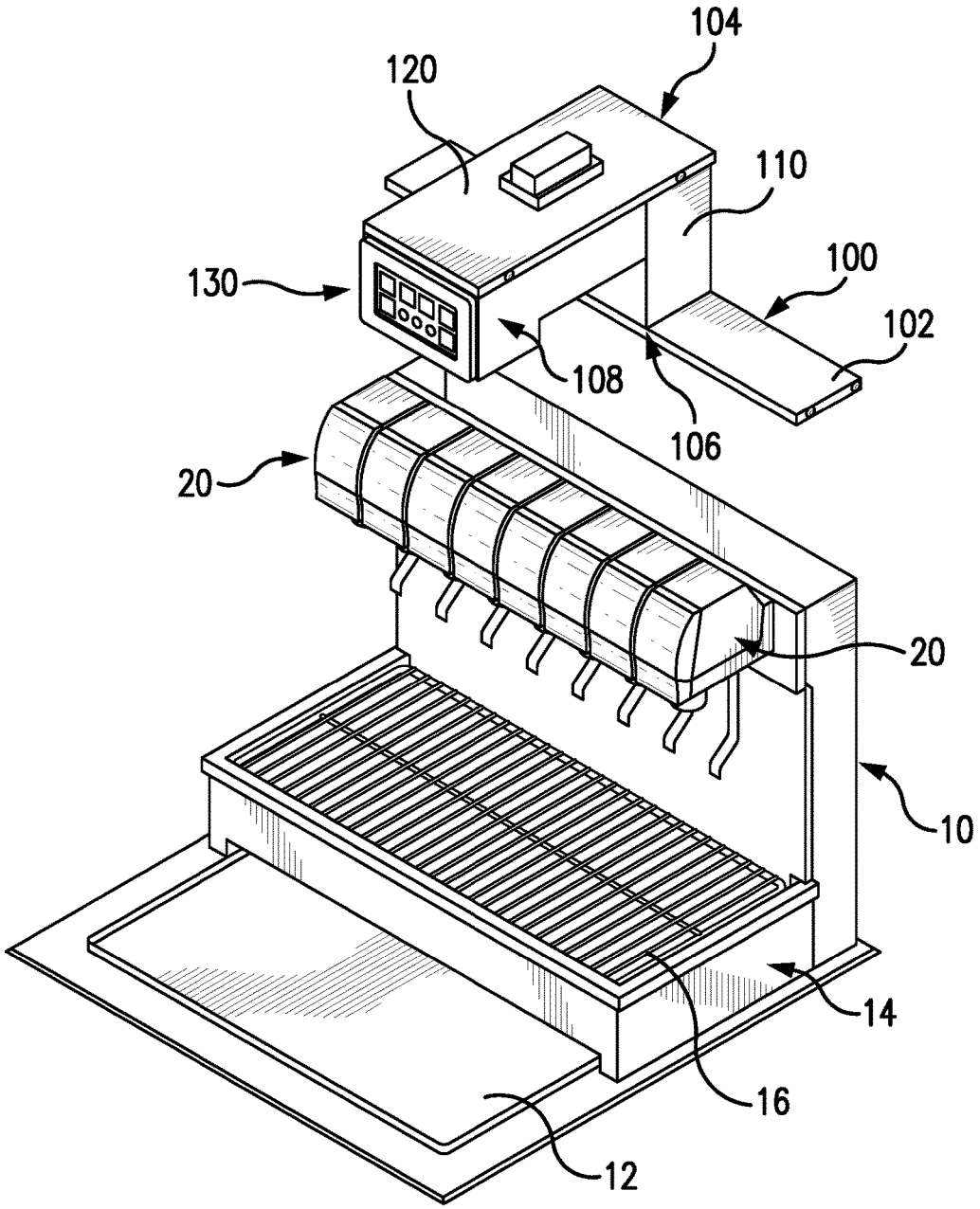
FIG. 2 is a partially exploded perspective view of a beverage dispensing system according to various aspects of the invention.
Figure 3:
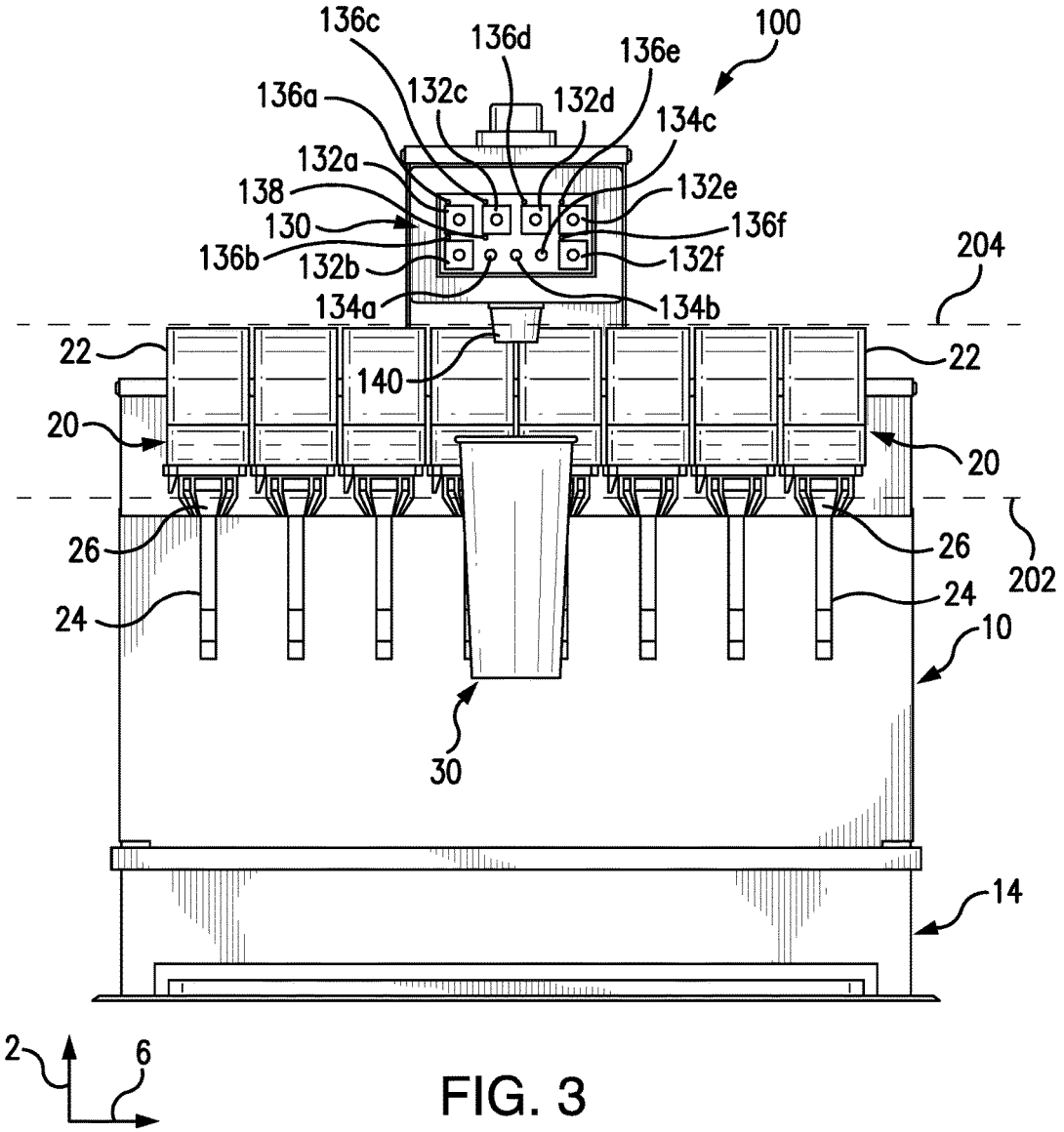
FIG. 3 is a front view of a beverage dispensing system according to various aspects of the invention.

As shown in FIGS. 1-3, beverage dispensing system 10 can include one or more dispensing valves 20. Each dispensing valve 20 can include a valve housing 22, a valve lever 24 to activate valve 20, and a valve nozzle 26. Beverage fluid can be supplied to beverage dispensing system 10 and can dispense from one or more of nozzles 26. In an aspect, beverage fluid can be supplied to beverage dispensing system 10 and can mix with a diluent, e.g., water or carbonated water, at one or more of valve nozzles 26. In an aspect, each dispensing valve 20 can include a push button (not shown) instead of valve lever 24 to activate dispensing valve 20. The push button can include a logo of the beverage to be dispensed from the beverage dispenser 10.

One or more of valve housings 22 can be positioned on dispenser housing 13 along width direction 6. In an aspect, one or more valve housings 24 can be attached to a valve retaining housing surface 18 positioned on dispenser housing 13. In another aspect, a plurality of valve housings 22 can be adjacent to each other and equally spaced along valve retaining housing surface 18.

In an aspect, one or more dispensing valves can be fluidly connected to a fluid line that supplies beverage concentrate syrup and a fluid line that supplies a carbonated or non-carbonated water to mix with the beverage concentrate syrup to create a finished beverage.

Figure 4:
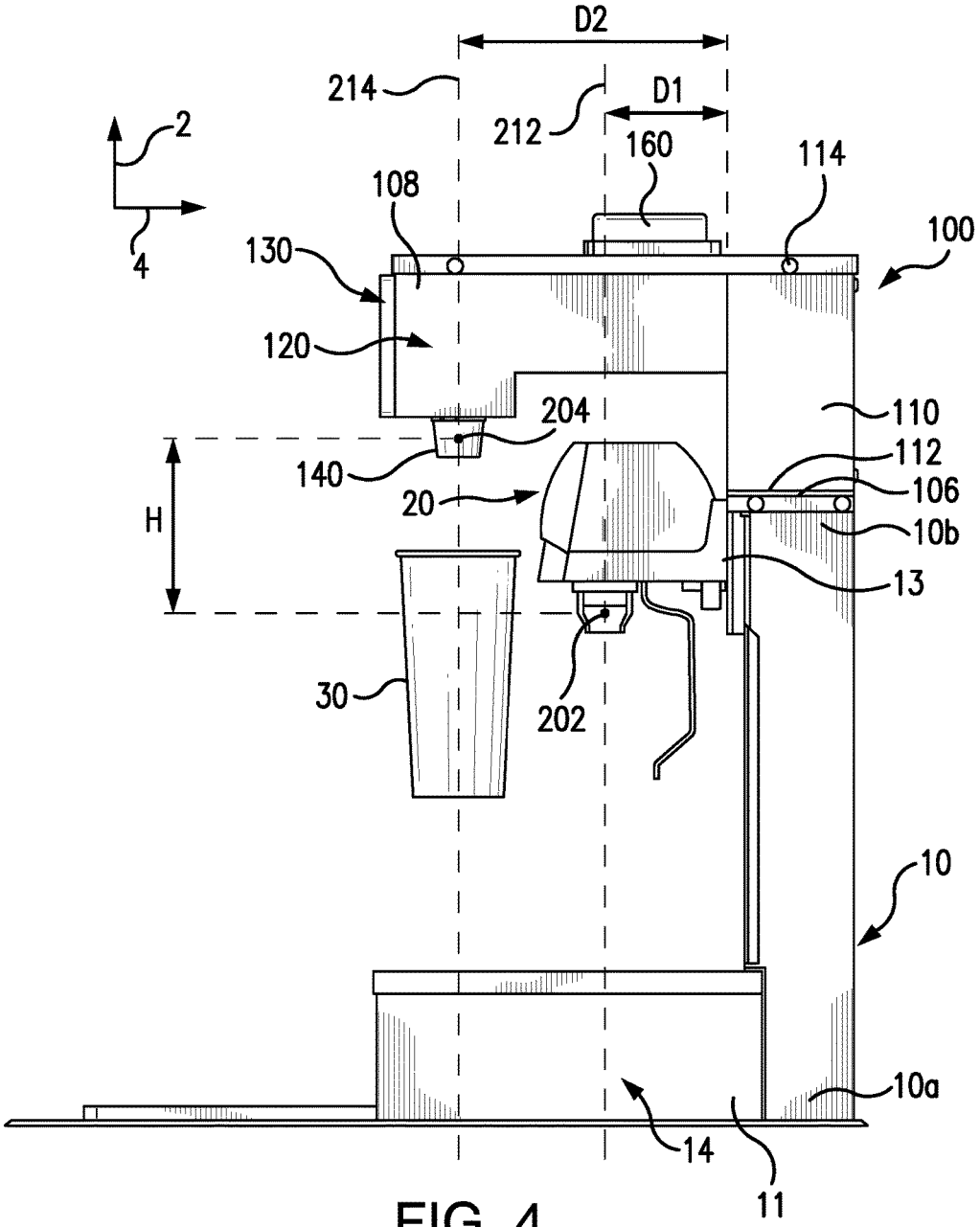
FIG. 4 is a side view of a beverage dispensing system according to various aspects of the invention.
Figure 5:
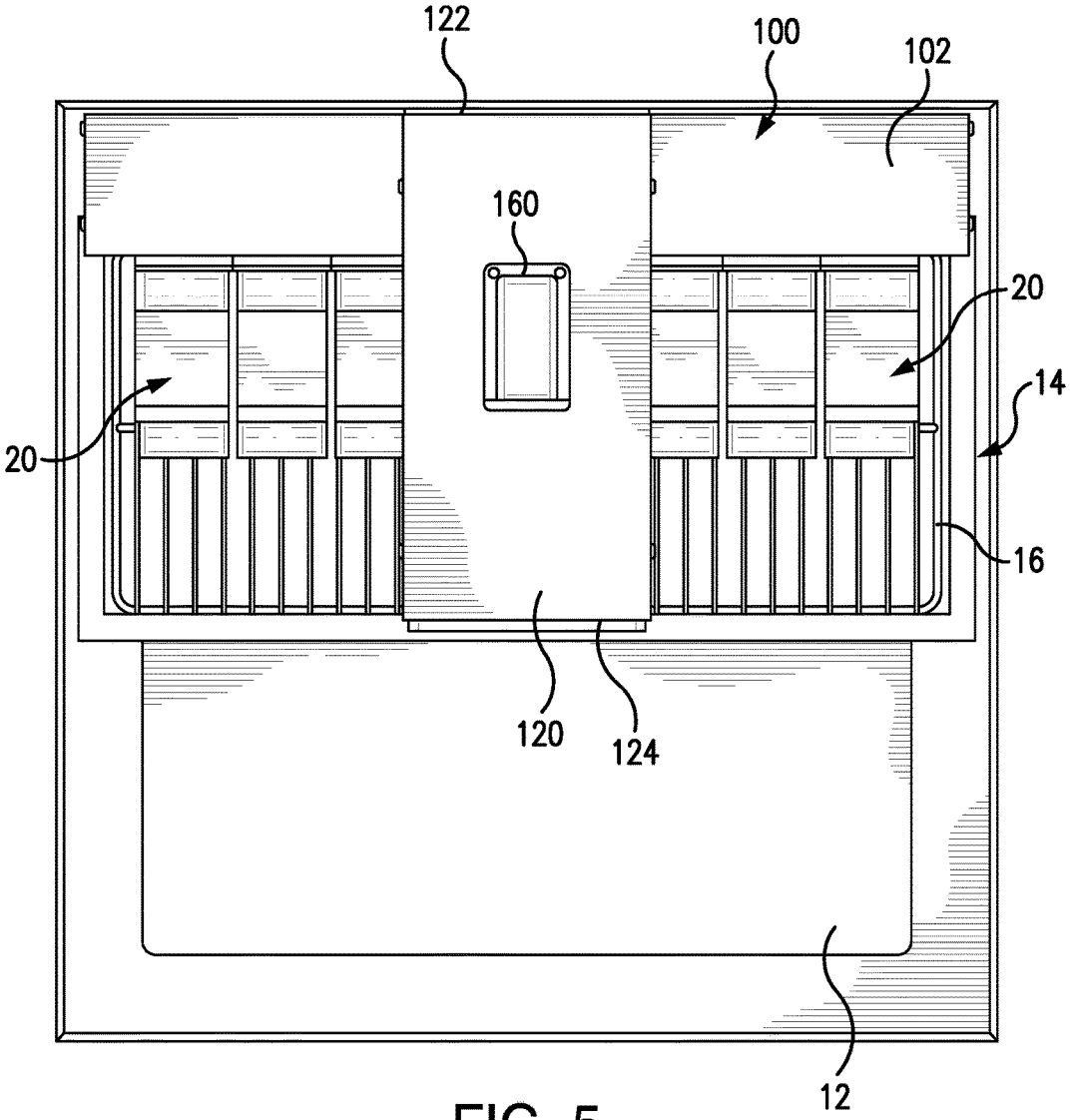
FIG. 5 is a top view of a beverage dispensing system according to various aspects of the invention.

As shown in FIGS. 3-4, one or more dispensing valves 20 including one or more valve nozzles 26 can be aligned along axis 202. In an aspect, a plurality of dispensing valves 20 can be generally aligned. For example, valve nozzles 26 can be generally aligned along axis 202. Axis 202 can extend along width direction 6. Axis 202 can be spaced a distance D1 from valve retaining housing surface 18. In an aspect, D1 can be a range from approximately zero inches to approximately 10 inches, such as approximately one inch to approximately eight inches, such as approximately one inch to approximately six inches, such as approximately one inch to approximately four inches.

In an aspect, one or more dispensing valves 20 can be positioned above drip tray 14 to dispense a fluid over drip tray 14. In this aspect, the receptacle within drip tray 14 can collect fluid waste from one or more dispensing valves 20.

As shown in FIGS. 1-4, nozzle module 100 can include a cover 102, a nozzle module housing 104, a module first end 106, a module second end 108, a control interface 130, and a nozzle 140. Nozzle 140 can be positioned adjacent second end 108. In one aspect, nozzle module 100 can connect to beverage dispenser 10, thus utilizing the vertical space above beverage dispenser 10. Nozzle module 100 can provide additional dispense points in a common location without the need for additional counter space. Nozzle module 100 can also allow a user to make a complete beverage at a single location. For example, a user can make a branded beverage and can add flavoring in a single location.

In an aspect, nozzle module housing 104 can extend above and/or outwardly from one or more dispensing valves 20. Module housing 104 can be connected to dispenser housing 13. In an aspect, beverage dispenser 10 can be retrofit with nozzle module 100. In this aspect, cover 102 can replace a beverage dispenser merchandizing module (not shown) positioned along upper end 10*b* of dispenser housing 13. For example, cover 102 can be connected to dispenser housing 13 and can utilize the same attachment points as the merchandizing module it is replacing. In addition, the nozzle module can be covered with merchandising material and can be positioned to avoid obscuring branding on beverage dispenser 10.

In another aspect, module first end 106 can be attached to dispenser housing 13. In an aspect, module first end 106 can be attached to dispenser housing 13 at dispenser upper end 10*b*. In another aspect, nozzle module housing 104 can be integral with dispenser housing 13.

Nozzle module housing 104 can include a vertical portion 110 and/or a horizontal portion 120. Vertical portion 110 can include a first end 112 and a second end 114. Horizontal portion 120 can include a proximal end 122 and a distal end 124. Nozzle 140 can be positioned adjacent distal end 124. In an aspect, first end 112 can be connected to dispenser housing 13. In another aspect, first end 112 can be connected to dispenser housing 13 at dispenser upper end 10*b*. In an aspect, nozzle 140 can be distal to dispenser housing 13 and distal to one or more nozzles 26 along horizontal direction 4.

In one aspect, horizontal portion 120 can be connected to dispenser housing 13. In another aspect horizontal portion 120 can be connected to vertical portion 110. For example, proximal end 122 of horizontal portion 120 can be connected to second end 114 of vertical portion 110. In an aspect, horizontal portion 120 can be integral with vertical portion 110.

As shown in FIGS. 3-4, nozzle 140 can be generally aligned along axis 204. Axis 204 can extend along width direction 6. Axis 204 can be parallel to axis 202. Axis 204 can be horizontally spaced from axis 202. In an aspect, axis 204 can be spaced a horizontal distance D2 from valve retaining housing surface 18. Distance D2 can be greater than distance D1. In an aspect, D2 can be a range from approximately zero inches to approximately 10 inches, such as approximately one inch to approximately nine inches, such as approximately two inches to approximately eight inches, such as approximately three inches to approximately seven inches, such as approximately four inches to approximately six inches. In another aspect, the difference between D2 and D1 can be a range from approximately one inch to approximately seven inches, such as approximately two inches to approximately five inches. In another aspect, distance D1 can be greater than distance D2.

In an aspect, axis 204 can be vertically spaced from axis 202. For example, axis 204 can be vertically spaced a height H from axis 202. Axis 204 can be positioned above axis 202. In another aspect, axis 202 can be positioned below axis 204. In one aspect, H can be a range from approximately zero inches to approximately 15 inches, such as approximately one inch to approximately 13 inches, such as approximately two inches to approximately 11 inches, such as approximately three inches to approximately nine inches, such as approximately four inches to approximately seven inches.

In an aspect, nozzle 140 and one or more dispensing valve 20 can be positioned above drip tray 14 to dispense fluids over drip tray 14. In this aspect, the receptacle within drip tray 14 can collect fluid waste from both nozzle 140 and one or more dispensing valves 20. In this manner, beverage dispensing system 10 and nozzle module 100 can utilize a common drip tray without the need to run additional drain lines.

FIGS. 2-3 illustrate nozzle module 100 and control interface 130. Control interface 130 can be programmable to allow for the correct dosage of beverage fluid for a selected beverage size. In one aspect, control interface 130 can include flavor input buttons 132 and size input buttons 134. A user may make desired selections, such as selections of a desired modifier, flavoring, or brand of beverage that can be dispensed from nozzle module 100. In one aspect of the invention flavor input buttons 132 and size input buttons 134 can be physical buttons electrically connected to a switch. In another aspect of the invention, control interface 130 can include a touch screen display and flavor buttons 132 and size buttons 134 can be graphical icons.

Control interface 130 can include between one and 10 flavor buttons 132. For example, control interface 130 can include five flavor buttons 132*a*-132*f*. Each of the respective flavor buttons 132 can include an icon that represents a modifier, flavoring, or brand of beverage to be dispensed. For example, in one aspect flavor button 132*a* can include an icon for cherry flavoring, flavor button 132*b* can include an icon for vanilla flavoring, flavor button 132*c* can include an icon for strawberry flavoring, flavor button 132*d* can include an icon for lemon flavoring, flavor button 132*e* can include an icon for lime flavoring, and flavor button 132*f* can include an icon for peach flavoring. In another aspect of the invention, flavor buttons 132*a*-132*f* can include an icon that represents a desired brand of beverage. For example, flavor buttons 132*a*-132*f* can include an icon that represents a desired brand of beverage. For example, flavor button 132*a* can include an icon for Sierra Mist®, flavor button 132*b* can include an icon for Tropicana®, flavor button 132*c* can include an icon for Diet Pepsi-Cola®, flavor button 132*d* can include an icon for Pepsi-Cola®, flavor button 132*e* can include an icon for Lipton Brisk® Iced Tea, and flavor button 132*f* can include an icon for Mountain Dew®.

In an aspect, control interface 130 can include flavor selection indicators 136*a*-136*f* to correspond to each of flavor buttons 132*a*-132*f*. In one aspect, when a flavor button is selected, the corresponding flavor selection indicator can illuminate. For example, when flavor button 132*a* is pressed, corresponding flavor selection indicator 136*a* can illuminate; when flavor button 132*b* is pressed, corresponding flavor selection indicator 136*b* can illuminate; when flavor button 132*c* is pressed, corresponding flavor selection indicator 136*c* can illuminate; when flavor button 132*d* is pressed, corresponding flavor selection indicator 136*d* can illuminate; when flavor button 132*e* is pressed, corresponding flavor selection indicator 136*e* can illuminate; and when flavor button 132*f* is pressed, corresponding flavor selection indicator 136*f* can illuminate.

In another aspect, when a fluid source that corresponds to a flavor button is sold out, the corresponding flavor selection indicator can remain illuminated. For example, when the fluid source that corresponds to flavor button 132*a* is sold out, corresponding flavor selection indicator 136*a* can remain illuminated; when the fluid source that corresponds to flavor button 132*b* is sold out, corresponding flavor selection indicator 136*b* can remain illuminated; when the fluid source that corresponds to flavor button 132*c* is sold out, corresponding flavor selection indicator 136*c* can remain illuminated; when the fluid source that corresponds to flavor button 132*d* is sold out, corresponding flavor selection indicator 136*d* can remain illuminated; when the fluid source that corresponds to flavor button 132*e* is sold out, corresponding flavor selection indicator 136*e* can remain illuminated; and when the fluid source that corresponds to flavor button 132*f* is sold out, corresponding flavor selection indicator 136*f* can remain illuminated. In another aspect, when a fluid source that corresponds to a flavor button is sold out, the corresponding flavor selection indicator can flash on and off.

Control interface 130 can also include between one and five size buttons 134. For example, control interface 130 can include three size buttons 134*a*-134*c*. In another aspect, control interface can include two size buttons 134*a* and 134*b*. Each of the respective size buttons 134 can include an icon that corresponds to a desired beverage size. For example, size button 134*a* can include an icon for a small beverage, size button 134*b* can include an icon for a medium beverage, and size button 134*c* can include an icon for a large beverage.

In an aspect, control interface 130 can include a programming indicator 138. Programming indicator 138 can flash on and off when control interface 130 is in the programming mode. In another aspect, programming indicator 138 can flash on and off when control interface 130 is in a priming mode, as discussed with respect to FIG. 10, below.

Figure 6:
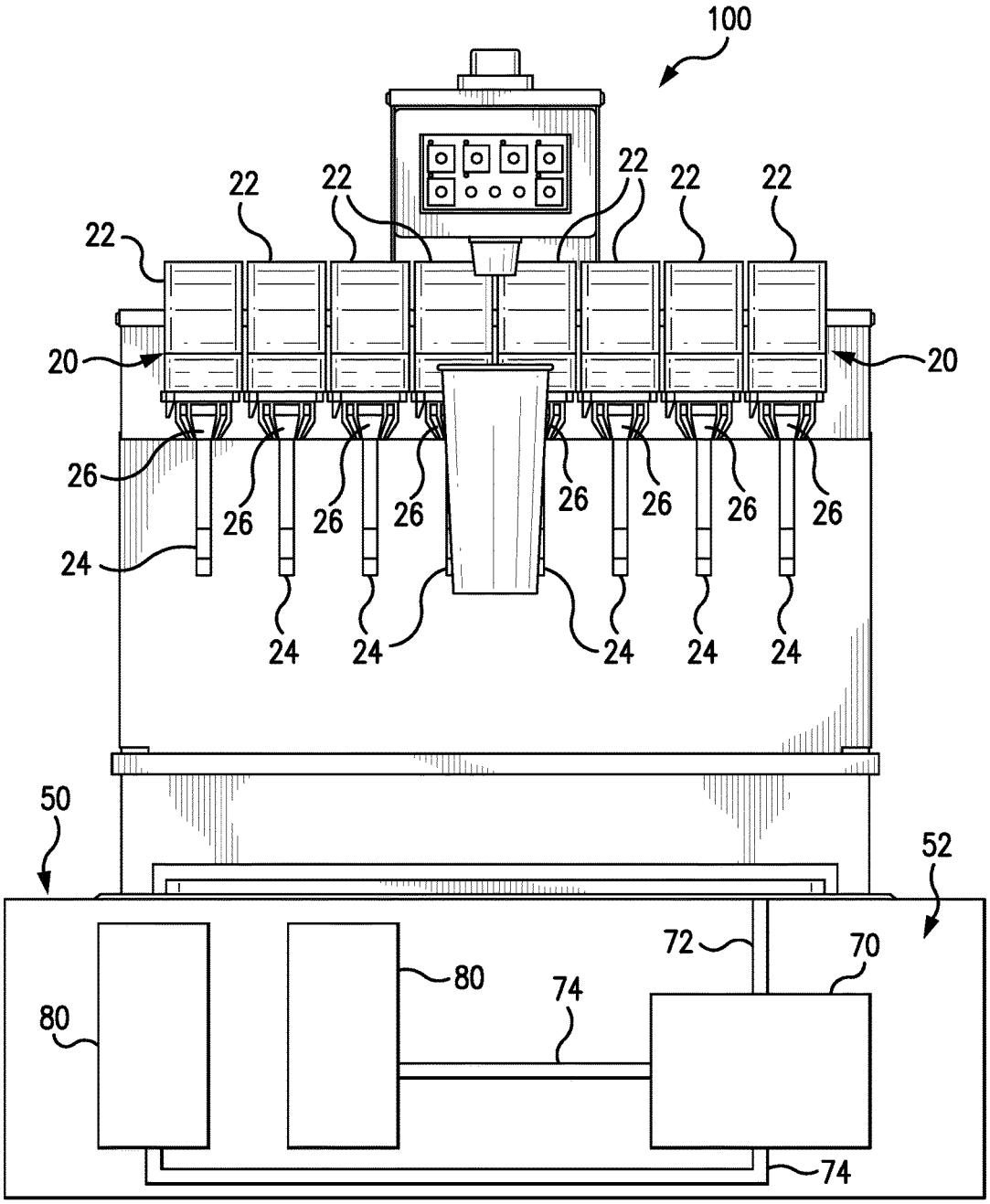
FIG. 6 is a front view of a beverage dispensing system according to various aspects of the invention.

As shown in FIGS. 1 and 6, beverage fluid can be supplied to beverage dispensing system 10 and/or nozzle module 100 by pumps 70 via fluid line 72. Pumps 70 can push the beverage fluid along fluid line 72. In an aspect, pumps 70 and beverage fluid sources 80 can be physically located in an area spaced apart from beverage dispensing system 10. For example, pumps 70 can be physically located in a back room 56, such as a storage room or food preparation area. In another aspect, beverage fluid sources 80 and pumps 70 can be positioned nearby the beverage dispensing unit. For example, beverage fluid sources 80 and pumps 70 can be positioned in an area 52 below a countertop 50 on which beverage dispensing system 10 rests.

Pumps 70 can be fluidly connected to beverage fluid sources 80 via fluid lines 74 (FIG. 6). In an aspect, beverage fluid sources 80 can be bag-in-box containers. In another aspect, beverage fluid sources 80 can include flavorings. For example, beverage fluid sources 80 can include cherry, strawberry, vanilla, lemon, peach, grape, lime, and/or raspberry flavoring. In this aspect, beverage fluid can be dispensed from nozzle module 100 into cup 30 without mixing with a diluent at nozzle 140.

In another aspect, beverage fluid sources 80 can include beverage concentrate syrup. For example, beverage fluid sources can include concentrate syrup for Sierra Mist®, Tropicana®, Diet Pepsi-Cola®, Pepsi-Cola®, Lipton Brisk® Iced Tea, Mountain Dew®, Diet Mountain Dew®, and/or MUG Root Beer®. In an aspect, a water line and/or a carbonated water line can be supplied to nozzle module 100. In this aspect, beverage fluid can mix with water or carbonated water at nozzle 140 to form a finished beverage.

In an aspect, nozzle module 100 can wirelessly communicate with pumps 70. In this aspect, a nozzle module 100 can include a wireless transceiver 160. Pumps 70 can include a wireless transceiver 60 to communicate with wireless transceiver 160.

Figure 7:
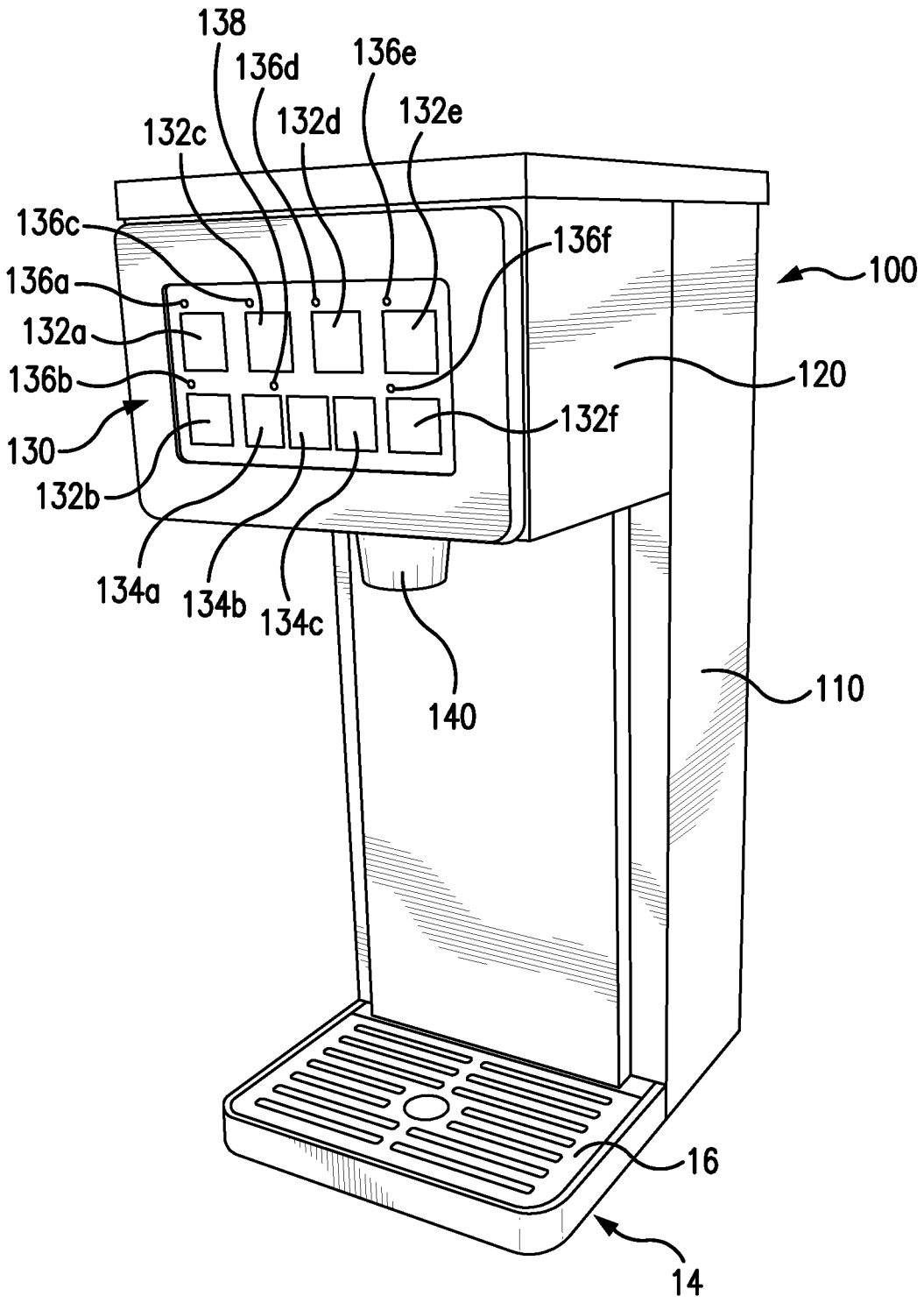
FIG. 7 is a perspective view of a beverage dispensing system according to various aspects of the invention.
Figure 8:
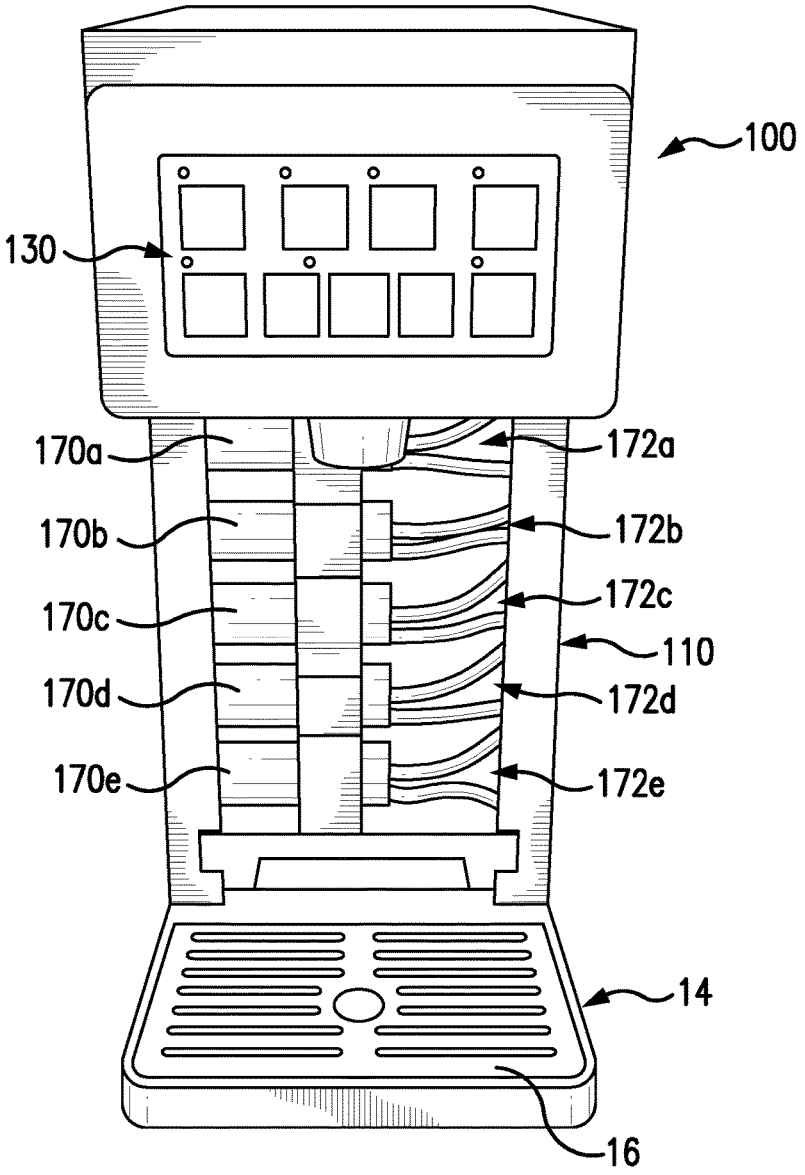
FIG. 8 is a top perspective view of a beverage dispensing system according to various aspects of the invention.

As shown in FIGS. 7-8, nozzle module 100 can be a stand-alone beverage dispensing tower. In this aspect, nozzle module housing 104 can be positioned on a countertop and directly connected to drip tray 14. In this aspect, nozzle module nozzle 140 can be solely positioned above drip tray 14 and drip tray grate 16.

In an aspect, nozzle module 100 can include pumps 170*a*-170*e* and fluid lines 172*a*-172*e*. Pumps 170*a*-170*e* and fluid lines 172*a*-172*e* can be positioned within nozzle module housing 104. For example, pumps 170*a*-170*e* and fluid lines 172*a*-172*e* can be positioned within vertical portion 110 of nozzle module housing 104. Pumps 170*a*-170*e* and fluid lines 172*a*-172*e* can supply beverage fluid to nozzle 104.

Nozzle module 100 shown in FIGS. 7-8 can include all the same features and functionality as nozzle module 100 discussed above with respect to FIGS. 1-6.

Figure 9A:
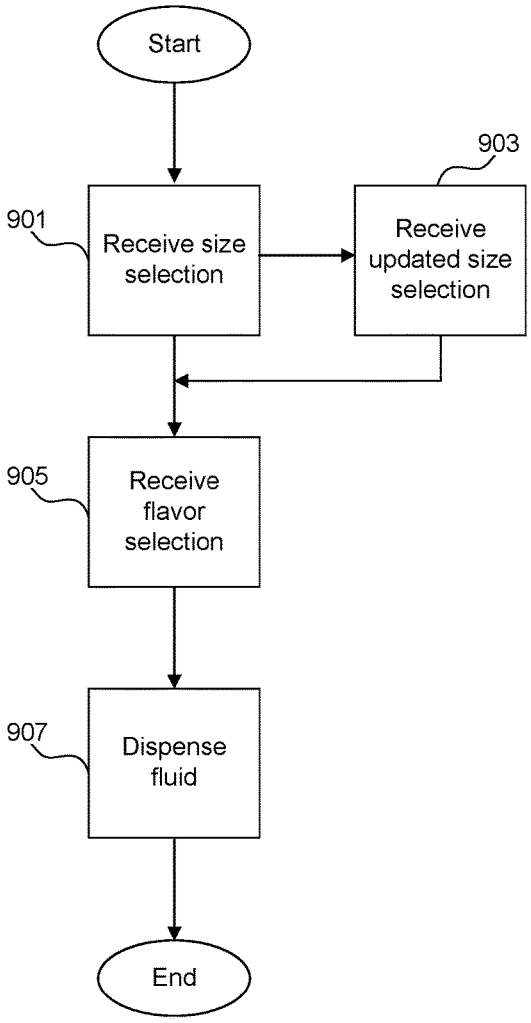
FIG. 9A is a block diagram of an example method for dispensing products according to various aspects of the invention.

The manner in which a user engages the control interface of the nozzle module to select and/or dispense a flavor can vary. FIG. 9A illustrates an example method for dispensing an available fluid in a "crew serve" mode according to an aspect of the invention.

At step 901, a selection of a beverage size may be received via input from the user using one of size buttons 134*a*-134*c*. The selected size remains active until another size is selected, for example, at step 903. When a flavor button is selected, the corresponding flavor selection indicator can illuminate. For example, when flavor button 132*a* is pressed, corresponding flavor selection indicator 136*a* can illuminate; when flavor button 132*b* is pressed, corresponding flavor selection indicator 136*b* can illuminate; when flavor button 132*c* is pressed, corresponding flavor selection indicator 136*c* can illuminate; when flavor button 132*d* is pressed, corresponding flavor selection indicator 136*d* can illuminate; when flavor button 132*e* is pressed, corresponding flavor selection indicator 136*e* can illuminate; and when flavor button 132*f* is pressed, corresponding flavor selection indicator 136*f* can illuminate. The corresponding flavor selection indicator can illuminate continuously or can flash on and off.

At step 903, an updated selection of a beverage size may be received via input from the user using another of size buttons 134*a*-134*c*. For example, a user might select a small size using button 134*a* in step 901, but before dispensing the fluid, update the size selection to a large size using button 134*c*.

At step 905, a selection of a flavor or type or brand of beverage may be received via input from the user using one of flavor buttons 132*a*-132*f* For example, a user may select one of flavor buttons 132*a*-132*f* that corresponds to cherry flavoring, vanilla flavoring, strawberry flavoring, lemon flavoring, lime flavoring, peach flavoring, Sierra Mist® branded beverage, Tropicana® branded beverage, Diet Pepsi-Cola® branded beverage, Pepsi-Cola® branded beverage, Lipton Brisk® Iced Tea branded beverage, Mountain Dew® branded beverage, Diet Mountain Dew® branded beverage, or MUG Root Beer® branded beverage.

At step 907, control interface 130 can send electronic signals to pumps 70 to cause nozzle module 100 to dispense from nozzle 140 the flavor or beverage selected at step 905 in the appropriate size selected at step 903. In an aspect, step 907 can initiate upon receipt of the flavor or type or brand selection in step 905.

Although the example method of FIG. 9A shows a particular order of steps, the exact order of the above steps could change, and the dispenser could receive additional input from the user before, after, and in between particular steps of the above example method. The order of the steps and/or what input is received during the course of a user's interaction with a dispenser may be dependent on the organization of the user interface.

Figure 9B:
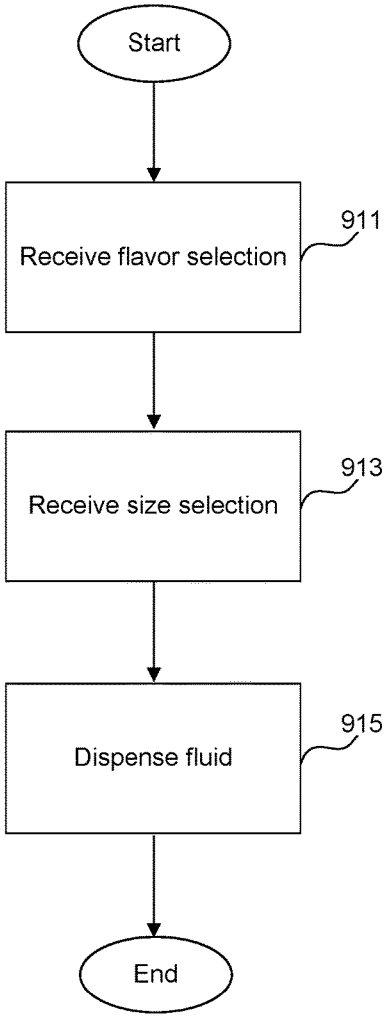
FIG. 9B is a block diagram of an example method for dispensing products according to various aspects of the invention.

FIG. 9B illustrates an example method for dispensing an available fluid in a "self-serve" mode according to an aspect of the invention.

At step 911, a selection of a flavor or type or brand of beverage may be received via input from the user via one of flavor buttons 132*a*-132*f*. For example, a user may select one of flavor buttons 132*a*-132*f* that corresponds to cherry flavoring, vanilla flavoring, strawberry flavoring, lemon flavoring, lime flavoring, peach flavoring, Sierra Mist® branded beverage, Tropicana® branded beverage, Diet Pepsi-Cola® branded beverage, Pepsi-Cola® branded beverage, Lipton Brisk® Iced Tea branded beverage, Mountain Dew® branded beverage, Diet Mountain Dew® branded beverage, or MUG Root Beer® branded beverage.

At step 913, a selection of a beverage size may be received via input from the user using one of size buttons 134*a*-134*c*.

At step 915, control interface 130 can send electronic signals to pumps 70 to cause nozzle module 100 to dispense from nozzle 140 the flavor or beverage selected at step 905 in the appropriate size selected at step 903. In an aspect, step 915 can initiate upon receipt of the beverage size selection in step 913.

Although the example method of FIG. 9B shows a particular order of steps, the exact order of the above steps could change, and the dispenser could receive additional input from the user before, after, and in between particular steps of the above example method. The order of the steps and/or what input is received during the course of a user's interaction with a dispenser may be dependent on the organization of the user interface.

Figure 10:
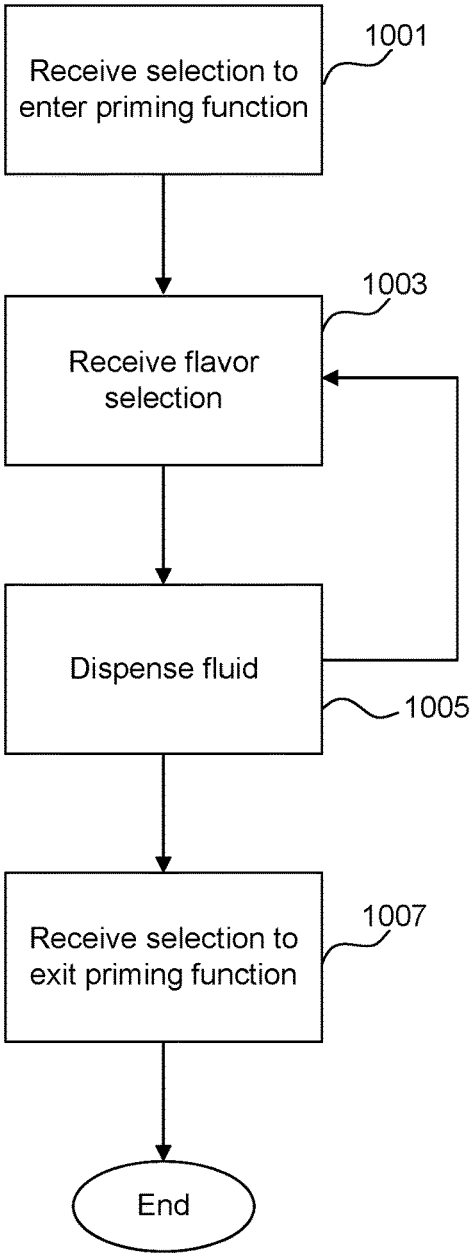
FIG. 10 is a block diagram of an example method for priming a nozzle module according to various aspects of the invention.

Priming of the pumps to push fluid through line 72 can be required when changing a product or to clear a sold out condition when one or more of concentrate sources 80 are empty. When changing products, priming avoids flavor cross-contamination from previous syrup flavors run through the line. FIG. 10 illustrates an example method for priming the fluid line.

At step 1001, a selection to enter the priming function may be received via input from the user. In one aspect, the input to enter the priming function may be a combination of two or more of buttons 132*a*-132*f* and/or 134*a*-134*c*. For example, a selection to enter the priming function may be received by the user simultaneously pressing size buttons 134*a* and 134*c*. Once the priming function is initiated, the programming indicator 138 can flash on and off. If a product is detected as sold out, the respective sold out flavor selection indicators 136*a*-136*f* can flash on and off.

At step 1003, a selection of a product, e.g., flavor or type or brand of beverage to prime may be received via input from the user using one of flavor buttons 132*a*-132*f*.

At step 1005, the selected fluid may be dispensed to prime the line. In an aspect of the invention, the selected flavor or type or brand of beverage may pump for a pre-determined period of time to clear the fluid line of any previous product and/or air and fill the fluid line with the desired product. In a further aspect of the invention, the selected flavor or type or brand of beverage may pump as long as the use continues to press the selected flavor button. In this aspect, the user should continue to press the selected flavor button until a steady stream of product flows from the line.

Steps 1003 and 1005 can be repeated for each product that needs to be primed.

At Step 1007, a selection to exit the priming function may be received via input from the user. In one aspect, the input to exit the priming function may be a combination of two or more of buttons 132*a*-132*f* and/or 134*a*-134*c*. For example, a selection to exit the priming function may be received by the user simultaneously pressing size buttons 134*a* and 134*c*. Once the priming function is ended, the programming indicator 138 may stop flashing.

Although the example method of FIG. 10 shows a particular order of steps, the exact order of the above steps could change, and the dispenser could receive additional input from the user before, after, and in between particular steps of the above example method. The order of the steps and/or what input is received during the course of a user's interaction with a dispenser may be dependent on the organization of the user interface.

Figure 11:
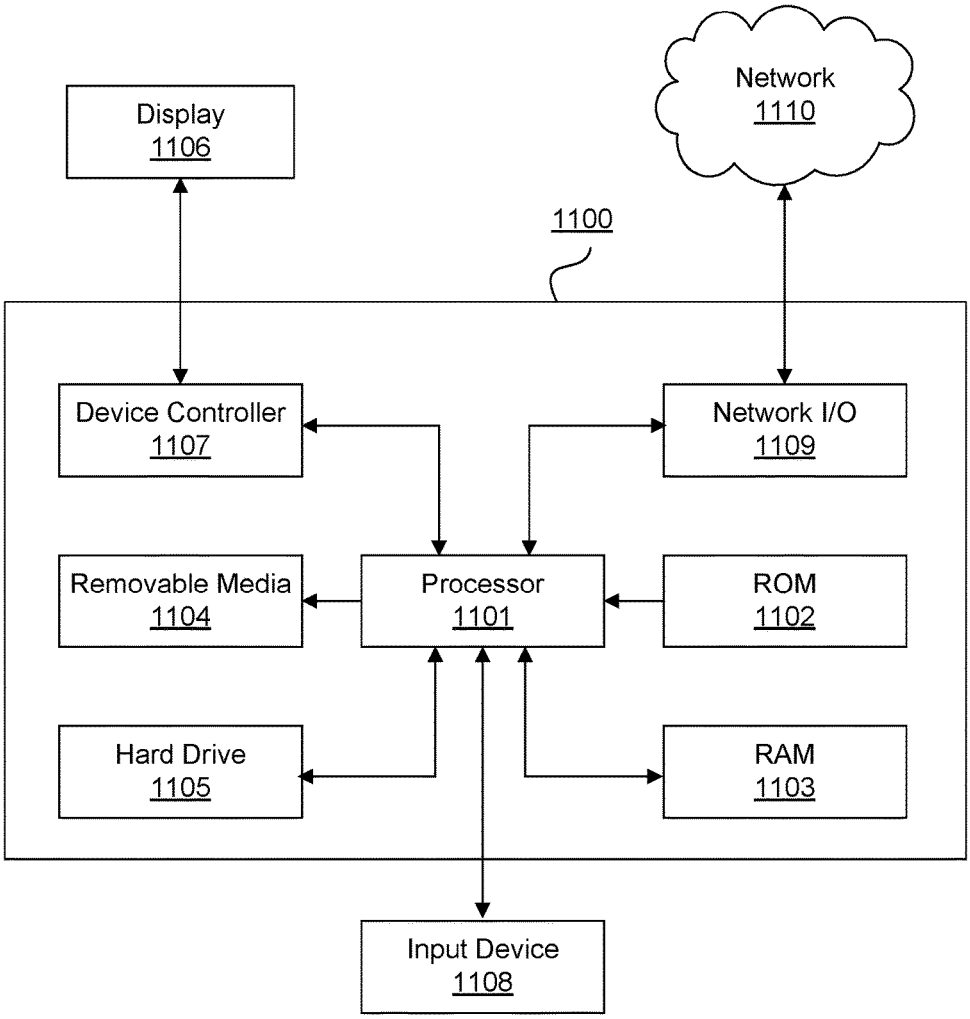
FIG. 11 illustrates an example hardware platform according to various aspects of the invention.

FIG. 11 illustrates an example computing device on which at least some of the various elements described herein can be implemented, including, but not limited to, various components of dispenser systems (e.g., beverage dispensing system 10 and/or nozzle module 100). Computing device 1100 may include one or more processors 1101, which may execute instructions of a computer program to perform, or cause to perform, any of the steps or functions described herein. The instructions may be stored in any type of computer-readable medium or memory, to configure the operation of the processor 1101. For example, instructions may be stored in a read-only memory (ROM) 1102, random access memory (RAM) 1103, removable media 1104, such as a Universal Serial Bus (USB) drive, compact disk (CD) or digital versatile disk (DVD), floppy disk drive, flash card, or any other desired electronic storage medium. Instructions may also be stored in an attached (or internal) hard drive 1105.

Control interface 130 and/or pumps 70 can be controlled by computing device 1100 that includes processors 1101. Computing device 1100 and processors 1101 receive electronic signals from control interface 130 and send electronic signals to initiate pumps 70. Computing device 1100 and processors 1101 can provide intelligent control of the beverage dispensing system 10.

Computing device 1100 and processors 1101 can also monitor system status such as the fluid temperatures, number of drinks dispensed, a sold out condition for one or more of diluent sources 80, and sensors that determine the amount of concentrate remaining in the beverage dispensing system. Computing device 1100 and processors 1101 can also provide service diagnostics, and the ability to remotely poll the electronic status.

Computing device 1100 may include one or more output devices, such as a display 1106, and may include one or more output device controllers 1107, such as a video processor. There may also be one or more user input devices 1008, such as a touch screen, remote control, keyboard, mouse, microphone, card reader, RFID reader, etc. The computing device 1100 may also include one or more network interfaces, such as input/output circuits 1109 to communicate with an external network 1110. The network interface may be a wired interface, wireless interface, or a combination of the two. In some embodiments, the interface 1109 may include a modem (e.g., a cable modem), and network 1110 may include the communication lines of the networks illustrated in FIG. 10, or any other desired network.

The FIG. 11 example is an illustrative hardware configuration. Modifications may be made to add, remove, combine, divide, etc. components as desired. Additionally, the components illustrated may be implemented using basic computing devices and components, and the same components (e.g., processor 1101, storage 1102, user input device 1108, etc.) may be used to implement any of the other computing devices and components described herein.

One or more aspects of the disclosure may be embodied in a computer-usable data and/or computer-executable instructions, such as in one or more program modules, executed by one or more computers or other devices. Generally, program modules include routines, programs, objects, components, data structures, etc. that perform particular tasks or implement particular abstract data types when executed by a processor in a computer or other data processing device. The computer executable instructions may be stored on one or more computer readable media such as a hard disk, optical disk, removable storage media, solid state memory, RAM, etc. The functionality of the program modules may be combined or distributed as desired in various embodiments. In addition, the functionality may be embodied in whole or in part in firmware or hardware equivalents such as integrated circuits, field programmable gate arrays (FPGA), controllers, application-specific integrated circuits (ASICS), combinations of hardware/firmware/software, and the like. Particular data structures may be used to more effectively implement one or more aspects of the invention, and such data structures are contemplated within the scope of computer executable instructions and computer-usable data described herein.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A beverage dispenser comprising:

a dispenser housing including a valve retaining housing surface;

a beverage dispensing valve extending from the dispenser housing, the beverage dispensing valve including a dispenser nozzle and a valve housing to attach to the valve retaining housing surface, the beverage dispensing valve being supported on the valve retaining housing surface such that the dispenser nozzle is generally aligned along a first axis; and a nozzle module including:

a nozzle module housing having a first end abutting an upper end of the dispenser housing and a second end extending from the first end; and a nozzle module nozzle adjacent the second end such that the nozzle module nozzle is aligned along a second axis that is parallel to and spaced apart from the first axis in a horizontal direction, wherein the first axis is spaced a first horizontal distance from the valve retaining housing surface and the second axis is spaced a second horizontal distance from the valve retaining housing surface such that the second horizontal distance is greater than the first horizontal distance.

2. The beverage dispenser of claim 1, wherein the second axis is spaced apart from the first horizontal axis a vertical distance in a range from approximately one inch to approximately 15 inches.

3. The beverage dispenser of claim 1, further comprising:

a second beverage dispensing valve extending from the dispenser housing, the second beverage dispensing valve including a second dispenser nozzle and a second valve housing to attach to the valve retaining housing surface, the second beverage dispensing valve being supported on the valve retaining housing surface such that the second dispenser nozzle is generally aligned along the first horizontal axis.

4. The beverage dispenser of claim 1, wherein the nozzle module housing is coupled to the dispenser housing.

5. The beverage dispenser of claim 1, wherein the nozzle module housing is integral with the dispenser housing.

6. The beverage dispenser of claim 1, wherein the nozzle module dispenses a premeasured amount of fluid based on a first user input.

7. The beverage dispenser of claim 1, further comprising:

a base attached to a lower end, the base including a waste collection portion having a receptacle area, wherein the dispenser nozzle is positioned above the receptacle area to dispense a first fluid into the receptacle area, and wherein the nozzle module nozzle is positioned above the receptacle area to dispense a second fluid into the receptacle area.

8. The beverage dispenser of claim 7, wherein the first fluid is an additive ingredient and the second fluid is a branded beverage.

9. The beverage dispenser of claim 7, the nozzle module further comprising:

a control interface for regulating delivery of the second fluid, the control interface including a switch; and an electronic control system coupled to the switch and configured to receive electronic control signals from the control interface to regulate the delivery of the second fluid.

10. A nozzle module for a beverage dispenser comprising:

a nozzle module housing having a lower end to attach to a beverage dispenser housing;

a nozzle module nozzle adjacent a second end of the nozzle module housing such that the nozzle module nozzle is configured to be spaced a first horizontal distance from the beverage dispenser housing;

a control interface for regulating delivery of a nozzle module fluid, the control interface including a switch and being coupled to the nozzle module housing; and an electronic control system coupled to the switch and configured to receive electronic control signals from the control interface to regulate the delivery of the nozzle module fluid, wherein the beverage dispenser includes a beverage dispenser nozzle spaced a second horizontal distance from the beverage dispenser housing, such that the first horizontal distance is greater than the second horizontal distance, wherein the beverage dispenser nozzle is positioned above a receptacle area to dispense a first fluid into the receptacle area, and wherein the nozzle module nozzle is positioned above the receptacle area to dispense a second fluid into the receptacle area.

11. The nozzle module of claim 10, wherein the first horizontal distance is a range from approximately one inch to approximately 10 inches.

12. The nozzle module of claim 10, wherein the nozzle module nozzle is configured to be spaced a vertical distance from the beverage dispenser nozzle.

13. The nozzle module of claim 12, wherein the vertical distance is a range from approximately one inch to approximately 15 inches.

14. The nozzle module of claim 10, wherein the nozzle module is configured to dispense a premeasured amount of fluid based on a first user input.

15. The nozzle module of claim 10, wherein the nozzle module is configured to dispense a premeasured amount based on a second user input.

* * * * *